US008274234B1

(12) United States Patent
Xiong

(10) Patent No.: US 8,274,234 B1
(45) Date of Patent: Sep. 25, 2012

(54) DIMMING BALLAST WITH PARALLEL LAMP OPERATION

(75) Inventor: Wei Xiong, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 470 days.

(21) Appl. No.: 12/633,621

(22) Filed: Dec. 8, 2009

(51) Int. Cl.
*H05B 37/02* (2006.01)

(52) U.S. Cl. ..... 315/219; 315/224; 315/225; 315/226; 315/240; 315/276; 315/209 R; 315/DIG. 5

(58) Field of Classification Search ..... 315/224–227, 315/240, 276, 219, 209 R, 95, 94, 307–308, 315/DIG. 4, DIG. 5
See application file for complete search history.

(56) References Cited

U.S. PATENT DOCUMENTS

| | | | | |
|---|---|---|---|---|
| 5,410,466 | A * | 4/1995 | Maehara | 363/98 |
| 5,546,300 | A * | 8/1996 | Lee et al. | 363/132 |
| 5,764,496 | A * | 6/1998 | Sato et al. | 363/37 |
| 5,877,592 | A | 3/1999 | Hesterman et al. | |
| 6,175,198 | B1 | 1/2001 | Nerone | |
| 6,531,831 | B2 | 3/2003 | Chou et al. | |
| 7,187,132 | B2 | 3/2007 | Bakre | |
| 7,193,368 | B2 | 3/2007 | Chen et al. | |
| 7,247,991 | B2 | 7/2007 | Chen et al. | |
| 7,723,929 | B2 * | 5/2010 | Orr | 315/308 |
| 7,880,399 | B2 * | 2/2011 | Sieβegger | 315/244 |
| 8,084,953 | B2 * | 12/2011 | Xie et al. | 315/219 |
| 2007/0285027 | A1 | 12/2007 | Gehman | |
| 2008/0042588 | A1 | 2/2008 | Chan et al. | |

* cited by examiner

*Primary Examiner* — Douglas W Owens
*Assistant Examiner* — Amy Yang
(74) *Attorney, Agent, or Firm* — Waddey & Patterson, P.C.; Mark J. Patterson; Gary L. Montle

(57) ABSTRACT

An electronic ballast is provided for powering one or more discharge lamps independently connected in parallel. An inverter having a pair of switching elements converts a DC supply signal into AC power. A transformer has a primary winding coupled to an output terminal of the inverter. A load circuit includes independently operable discharge lamp circuits coupled in parallel with each other and across a secondary winding of the transformer. An inductance control circuit includes an inductive element coupled in series with the primary winding of the transformer and a bi-directional switch coupled in parallel across the inductive element. A switch state of the bi-directional switch is controllably adjustable between first and second switch states and in accordance with a desired duty ratio. A magnitude of a voltage across the secondary winding of the transformer and thereby across each lamp circuit is dependent on the switch state of the bi-directional switch.

20 Claims, 3 Drawing Sheets

DIMMING BALLAST WITH PARALLEL LAMP OPERATION

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: None

BACKGROUND OF THE INVENTION

The present invention relates generally to electronic ballast circuits for powering discharge lamps connected in parallel. More particularly, the present invention relates to programmed start electronic ballasts capable of performing dimming operations on multiple discharge lamps connected in parallel.

Electronic ballasts with dimming features are rapidly increasing in popularity, due in part to their capabilities in light output control and energy saving. However, most dimming ballasts can not independently operate a plurality of discharge lamps connected in true parallel mode. In many, if not most, existing configurations lamps are connected in series, which means that if any one lamp fails for some reason or is removed from the circuit all of the accompanying lamps are going to be shut down as well. This results in great expense where it is necessary to replace each inoperable lamp with each such failure even among a large number of lamps in a circuit.

Programmed start ballasts are known in the art for applying a relatively small current to preheat lamp filaments, or cathodes, during a startup process. Particularly where lights are expected to be turned on and off at a high frequency, programmed start ballasts extend the lives of the associated lamps by minimizing glow discharge current. It is not desirable to continue applying the preheat current across the lamp filaments after the lamps have been ignited and are operating at full power, as there is no additional illumination provided and therefore the energy spent is merely wasted. However, in certain situations it is still desirable to have some supplemental current supplied across the lamp filaments to maintain a proper temperature after startup, particularly where a low dimming voltage is provided across the lamps.

Some electronic ballast circuits have been introduced and are known in the prior art to address various combinations of continuous dimming, programmed start with preheat current cutoff, and true parallel lamp operation. However, the additional circuitry required for many of these circuits, particularly with regards to the programmed start ballasts, can be prohibitive with regards to size, complexity and cost.

BRIEF SUMMARY OF THE INVENTION

In accordance with various aspects of the present invention, an electronic ballast circuit is provided for powering one or more discharge lamps. The ballast includes circuitry configured to independently operate a plurality of lamps connected in parallel with each other, such that any one lamp may fail or be physically removed without adversely affecting operation of the remaining lamps.

The electronic ballast circuit may further be able to provide programmed start functions for the one or more lamps.

The electronic ballast circuit may further be able to provide continuous dimming functions for the one or more lamps with proper filament heating.

The electronic ballast circuit may further cut off the filament heating feature when the one or more lamps are operating at a full or maximum lighting output.

In a first embodiment of the present invention, an electronic ballast is provided for powering one or more discharge lamps and further for providing filament pre-heating. An inverter circuit has a pair of switching elements and is configured to convert a DC supply signal into an AC signal. A first transformer has a primary winding coupled to an output terminal between the pair of switching elements of the inverter circuit. A load circuit includes the one or more discharge lamps and is coupled in parallel with a secondary winding of the first transformer. A second transformer has a primary winding coupled in series with the primary winding of the first transformer, and further has one or more secondary windings coupled across filaments of the one or more discharge lamps in the load circuit. A switching circuit is coupled across the primary winding of the second transformer and a magnitude of a voltage across the secondary winding of the first transformer is dependent on a switch state of the switching circuit.

In a second embodiment of the present invention, an electronic ballast is provided for powering one or more discharge lamps and is configured to continuously dim the lamps as desired. An inverter circuit has a pair of switching elements and is configured to convert a DC supply signal into an AC signal. A transformer having a primary winding is coupled to an output terminal between the pair of switching elements of the inverter circuit. A load circuit includes the one or more discharge lamps and is coupled in parallel with a secondary winding of the transformer. An inductance control circuit includes an inductive element coupled in series with the primary winding of the transformer and a bi-directional switch coupled in parallel across the inductive element. A switch state of the bi-directional switch is controllably adjustable in accordance with a desired duty ratio, and a magnitude of a voltage across said secondary winding of the transformer is dependent on a switch state of the bi-directional switch.

In a third embodiment of the present invention, an electronic ballast is configured for powering and providing continuous dimming of one or more discharge lamps connected in parallel. An inverter circuit has a pair of switching elements and is configured to convert a DC supply signal into an AC signal. A transformer having a primary winding is coupled to an output terminal between the pair of switching elements of the inverter circuit. A load circuit includes the one or more independently operable discharge lamp circuits coupled in parallel with each other and across a secondary winding of the transformer, with each discharge lamp circuit further having a discharge lamp and a capacitor coupled in series. An inductance control circuit includes an inductive element coupled in series with the primary winding of the transformer and a bi-directional switch coupled in parallel across the inductive element. A switch state of the bi-directional switch is controllably adjustable in accordance with a desired duty ratio, with a magnitude of a voltage across said secondary winding of the transformer being dependent on a switch state of the bi-directional switch. A magnitude of a voltage across each lamp circuit is further dependent on a switch state of the bi-directional switch.

DETAILED DESCRIPTION OF THE INVENTION

Figure 1:
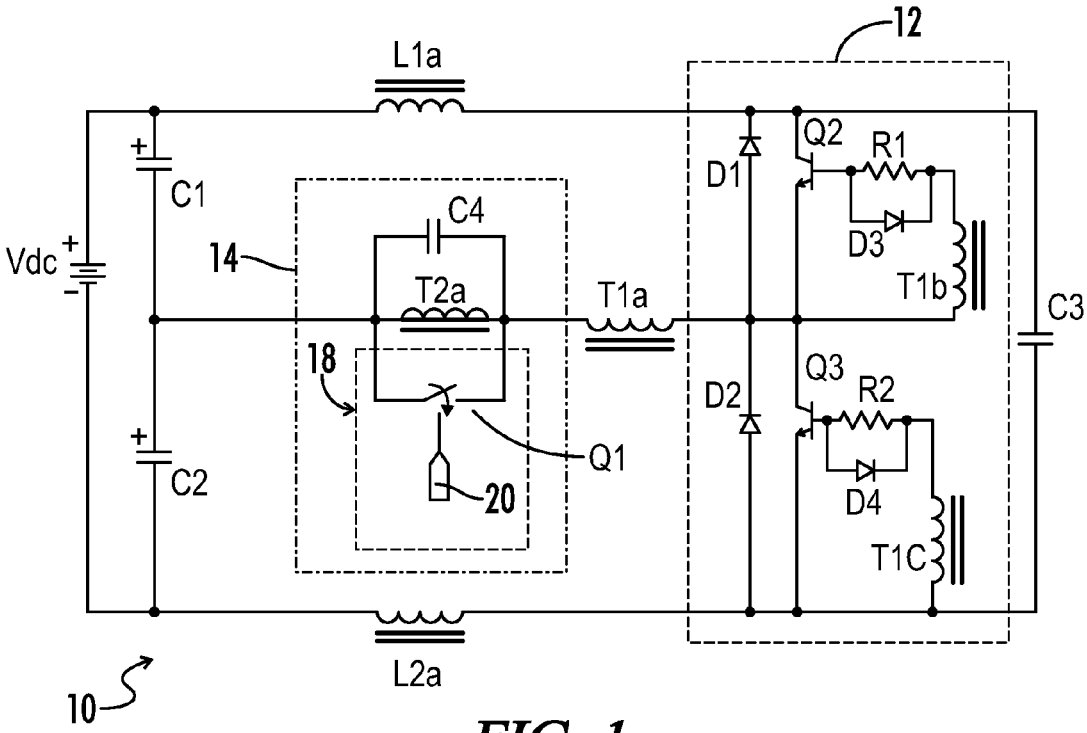
FIG. 1 is a circuit diagram showing an embodiment of electronic ballast circuitry in accordance with the present invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may. The term "coupled" means at least either a direct electrical connection between the connected items or an indirect connection through one or more passive or active intermediary devices. The term "circuit" means at least either a single component or a multiplicity of components, either active and/or passive, that are coupled together to provide a desired function. The term "signal" means at least one current, voltage, charge, temperature, data or other signal. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

Referring generally to FIGS. 1-3*b*, various embodiments of an electronic ballast are described herein for powering one or more discharge lamps. Where the various figures may describe embodiments sharing various common elements and features with other embodiments, similar elements and features are given the same reference numerals and redundant description thereof may be omitted below.

In an embodiment as shown in FIG. 1, an electronic ballast 10 of the present invention may be provided with a current-fed, parallel and self-oscillating circuit topology. An inverter circuit 12 as shown includes a pair of switching elements Q2 and Q3 and may be configured to convert a DC supply signal from a source Vdc into an AC signal. A first transformer T1 has a primary winding T1*a* that may be coupled to an output terminal between the pair of switching elements Q2 and Q3 of the inverter circuit 12. A load circuit 16 may include one or more discharge lamps La1 . . . Lan, and is coupled in parallel with a secondary winding T1*d* of the first transformer T1. An inductance control circuit 14 includes an inductive element T2*a* coupled in series with the primary winding T1*a* of the first transformer T1 and a switching circuit 18 coupled in parallel across the inductive element T2*a*. A magnitude of a voltage across the secondary winding T1*d* of the first transformer T1 is dependent on a switch state of the switching circuit Q1.

The electronic ballast 10 may further include inductors L1*a* and L1*b* which actually form one coupled inductor acting as a current source. Capacitors C1 and C2 may be electrolytic capacitors which provide a middle voltage potential for a resonant circuit having as its main components the inductive element T2*a*, the primary winding T1*a* of the first transformer T1, and a capacitor C3.

In various embodiments as shown in FIG. 1, the switching elements Q2 and Q3 of the inverter circuit 12 may be power bipolar junction transistors. Diodes D1 and D2 may be included as free-wheeling diodes for switching elements Q2 and Q3 respectively. The first transformer T1 may further include a secondary winding T1*b* coupled across the gate and drain of switching element Q2, and a secondary winding T1*c* coupled across the gate and drain of switching element Q3. Resistor R1 and diode D3 are coupled in parallel, and together are coupled in series between the gate of switching element Q2 and the secondary winding T1*b* of the first transformer T1. Resistor R1, diode D3 and the secondary winding T1*b* of the first transformer T1 drive the switching element Q2. Resistor R2 and diode D4 are coupled in parallel, and together are coupled in series between the gate of switching element Q3 and the secondary winding T1*c* of the first transformer T1. Resistor R2, diode D4 and the secondary winding T1*c* of the first transformer T1 drive the switching element Q3. The switching elements Q2 and Q3 may in accordance with the topology as described herein be driven in a self-oscillating fashion.

The inductive element T2*a* of the inductance control circuit 14 may consist of a primary winding T2*a* of a second transformer T2. The inductance control circuit 14 may further include a capacitor C4 coupled in parallel across the primary winding T2*a* of the second transformer T2 and with the switching element Q1. The switching circuit 18 in various embodiments includes a bi-directional switch Q1 which is configured to change switch states by turning on and off in response to a control signal supplied from a control source 20 as is well known in the art.

Figure 2:
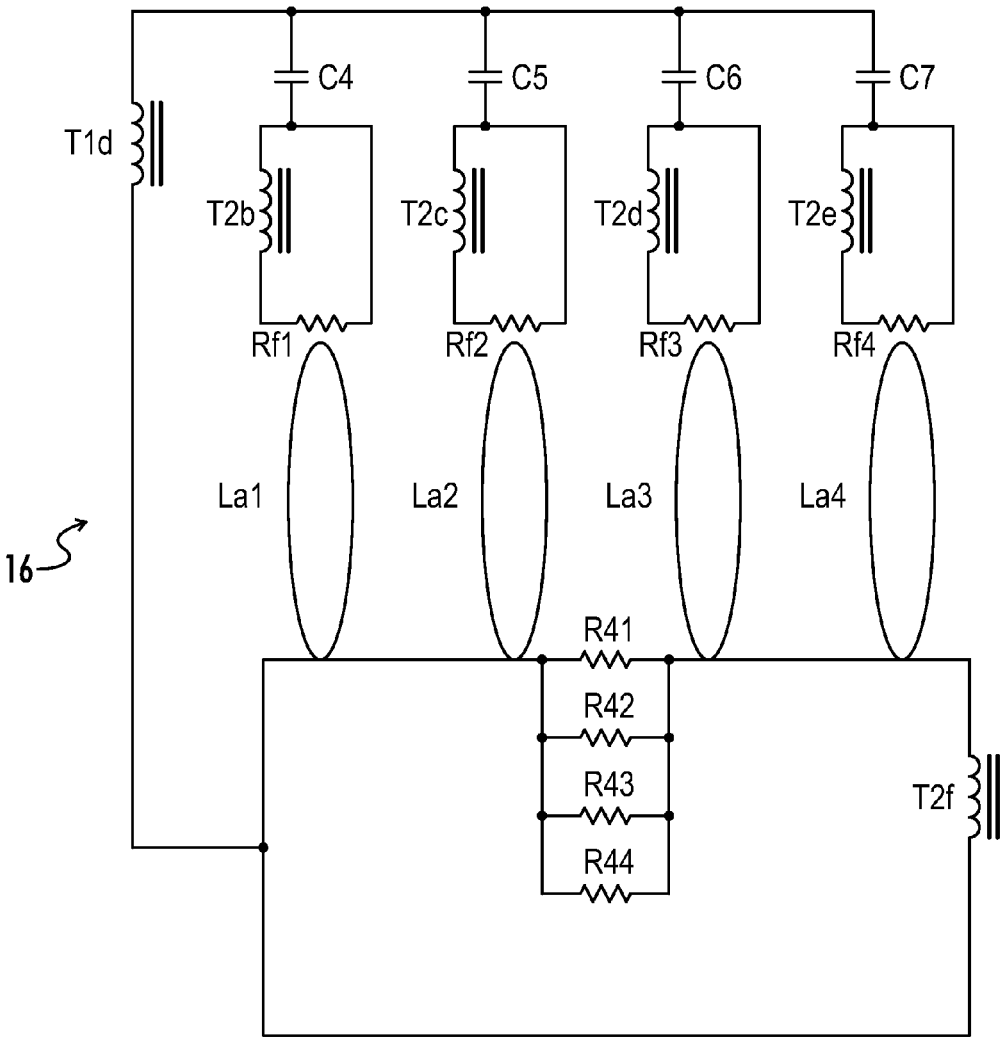
FIG. 2 is a circuit diagram showing an embodiment of a load circuit in accordance with the electronic ballast of FIG. 1.

Referring to FIG. 2, the load circuit 16 may be described as including one or more lamp circuits coupled in parallel with the secondary winding T1*d* of the first transformer T1. Alternatively, the load circuit 16 may include a single lamp or a plurality of lamps coupled in series within the scope of the present invention.

In the embodiment shown, a first lamp circuit includes a first lamp La1, a secondary winding T2*b* of the second transformer T2 coupled across a filament Rf1 on a first end of the first lamp La1, and a capacitor C4 coupled in series between the secondary winding T2*b* of the second transformer T2 and the secondary winding T1*d* of the first transformer T1. A second lamp circuit includes a second lamp La2, a secondary winding T2*c* of the second transformer T2 coupled across a filament Rf2 on a first end of the second lamp La2, and a capacitor C5 coupled in series between the secondary winding T2*c* of the second transformer T2 and the secondary winding T1*d* of the first transformer T1. A third lamp circuit includes a third lamp La3, a secondary winding T2*d* of the second transformer T2 coupled across a filament Rf3 on a first end of the third lamp La3, and a capacitor C6 coupled in series between the secondary winding T2*d* of the second transformer T2 and the secondary winding T1*d* of the first transformer T1. A fourth lamp circuit includes a fourth lamp La4, a secondary winding T2*e* of the second transformer T2 coupled across a filament Rf4 on a first end of the fourth lamp La4, and a capacitor C7 coupled in series between the secondary winding T2*e* of the second transformer T2 and the secondary winding T1*d* of the first transformer T1.

In an embodiment as shown in FIG. 2, each lamp La1-La4 on a second end includes filaments Ry1-Ry4, respectively. Lamp filaments Ry1-Ry4 are coupled in parallel, with a secondary winding T2*f* further coupled across the parallel circuit including each of the filaments Ry1-Ry4.

Fewer or additional lamp circuits may of course be anticipated as within the scope of the present invention.

Operation of embodiments of the present invention as shown in FIGS. 1-2 may now be described herein.

During operation of the electronic ballast at full, maximum lighting of the one or more lamps, the switching circuit 18 of the inductance control circuit 14 is in a first switch state, wherein the bi-directional switch Q1 is controlled to be turned on by a control source 20. In this manner the inductive element T2*a*, or rather the primary winding T2*a* of the second transformer T2, and the capacitor C4 are shorted out of the circuit. When the switch Q1 is on, there is therefore no additional inductance provided from the inductance control circuit and the voltage drop on the primary winding T1*a* of the first transformer T1 will be:

$$V_T1a_rms=(\pi*Vdc)/(4*\sqrt{2})$$

No voltage is provided across the primary winding T2*a* of the second transformer T2, and therefore current is cut off from secondary windings of the second transformer T2 when the ballast 10 is operating at full light output. In this manner no power is unnecessarily or redundantly spent at full light output.

Alternatively, in an embodiment of the present invention a programmed start ballast function requires that lamp voltage during a preheat period should be less than a certain voltage to make sure that there is no excess glow current during the preheating time. By adding the additional inductance of the second transformer T2, the voltage reduction requirement may be met. The switching circuit Q1 may be set to a second switch state with the bi-directional switch Q1 controlled to be turned off by the control source 20. In this manner the inductive element T2*a*, or rather the primary winding T2*a* of the second transformer T2, and the capacitor C4 are in series with the primary winding T1*a* of the first transformer T1. The voltage across the primary winding T1*a* of the first transformer T1 during preheat may thereby be controlled to:

$$V_T1a_rms=[(\pi*Vdc)/(4*\sqrt{2})]*[T1L)/(T1L+T2L)]$$

where T1L and T2L are the primary inductance for the primary winding T1*a* of the first transformer T1 and the primary inductance for the primary winding T2*a* of the second transformer T2, respectively. As a result a magnitude of the voltage across the load circuit 16 during the preheat period will be:

$$V_T1d_rms=[(\pi*Vdc)/(4*\sqrt{2})]*[T1L)/(T1L+T2L)]*N$$

where N is the turns ratio between the primary winding T1*a* of the first transformer T1 and the secondary winding T1*d* of the first transformer T1.

In the embodiment described above, by properly designing the primary inductance values T1L and T2L of the first and second transformers T1 and T2, respectively, the voltage generated across the primary winding T1*a* of the first transformer T1 during a preheat period, associated with a second switch state of the switching circuit 18, will be small enough that a magnitude of the voltage across the secondary winding T1*d* of the first transformer T1 will be small enough not to ignite the lamps during preheating.

In contrast to the first switching state, where the inductive element T2*a* is shorted out and no voltage is generated across the winding, in the second switching state a voltage is generated across the primary winding T2*a* of the second transformer T2. Referring to FIG. 2, the secondary windings T2*b*-T2*f* are arranged to preheat the lamp filaments Rf1-Rf4 and Ry1-Ry4 and facilitate longer discharge lamp life.

The first and second switch states may be controllably adjusted in accordance with a desired period of time for which the preheating of lamp filaments Rf1-Rf4 and Ry1-Ry4 is to be conducted.

In another embodiment, the electronic ballast 10 of the present invention may be operated to perform continuous dimming control of one or more discharge lamps.

As described above, when the bi-directional switch Q1 is in a first (ON) state, the voltage across the secondary winding T1*d* of the first transformer T1 is at a maximum level wherein the lamp is operated at full brightness or maximum current. There is no voltage generated across the inductive element T2*a* of the inductance control circuit 14, or primary winding T2*a* of the second transformer T2, in this state. Therefore, there is no voltage provided across the filaments Rf1-Rf4 and Ry1-Ry4 and filament heat cutoff is achieved.

Alternatively, when the bi-directional switch Q1 is in a second (OFF) state, the voltage across the secondary winding T1*d* of the first transformer T1 is at a minimum level wherein the lamp is operated at minimum dimming or minimum current. The voltage drop across the primary winding T2*a* of the second transformer T2 will provide heating for the lamp filaments Rf1-Rf4 and Ry1-Ry4 when the ballast 10 is in a dimming mode.

Figure 3A:
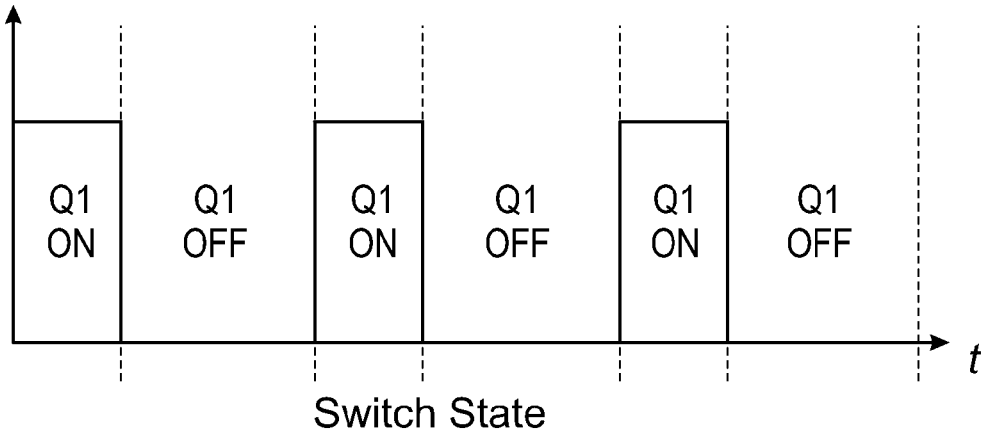
FIGS. 3*a*-3*b* are graphical displays showing discharge lamp current modulation with respect to time in accordance with a mode of operation of the electronic ballast of FIG. 1.
Figure 3B:
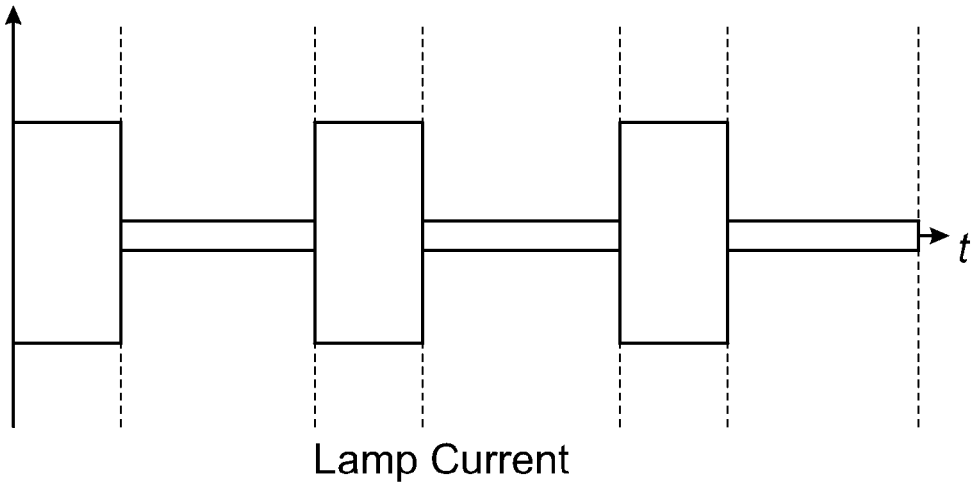

By properly adjusting the ON and OFF times of the bi-directional switch Q1, a continuous dimming of the one or more lamps La1 . . . Lan may be achieved, ranging from a maximum (100%) current across the lamps to a minimum current associated with the predetermined inductance relationships between the transformers T1 and T2 as described above. Referring to FIGS. 3*a* and 3*b*, lamp current modulation with respect to time may be illustrated in accordance with adjusted ON and OFF times of the bi-directional switch Q1, as controlled by a dimming signal provided by the control source 20.

The previous detailed description has been provided for the purposes of illustration and description. Thus, although there have been described particular embodiments of the present invention of a new and useful "Dimming Ballast with Parallel Lamp Operation," it is not intended that such references be construed as limitations upon the scope of this invention except as set forth in the following claims.

What is claimed is:

1. An electronic ballast comprising:

an inverter circuit comprising a pair of switching elements and configured to convert a DC supply signal into an AC signal;

a first transformer having a primary winding coupled to an output terminal between the pair of switching elements of the inverter circuit and a secondary winding;

a load circuit comprising one or more discharge lamps each having lamp filaments, the load circuit coupled in parallel with the secondary winding of the first transformer;

a second transformer having a primary winding coupled in series with the primary winding of the first transformer, and further having one or more secondary windings coupled across the filaments of the one or more discharge lamps in the load circuit; and a switching circuit coupled across the primary winding of the second transformer, wherein a magnitude of a voltage across said secondary winding of the first transformer is dependent on a switch state of the switching circuit.

2. The ballast of claim 1, the switching circuit further comprising a first switch state wherein the voltage across said secondary winding of the first transformer is at a maximum level, and wherein there is no voltage across the secondary windings of the second transformer.

3. The ballast of claim 2, the switching circuit further comprising a second switch state wherein the voltage across said secondary winding of the first transformer is at a minimum level insufficient to ignite the one or more discharge lamps, and wherein a voltage across the secondary windings of the second transformer preheats the filaments of the one or more discharge lamps.

4. The ballast of claim 3, wherein the voltage across said secondary winding of the first transformer in the second switch state is associated with a relationship between predetermined primary inductance values for the first and second transformers and with a turns ratio between the primary winding and the secondary winding of the first transformer.

5. The ballast of claim 4, wherein the switching circuit further comprises a bi-directional switch, the switching circuit configured to controllably adjust the switch state of the bi-directional switch in accordance with a desired duty ratio, wherein the voltage across said secondary winding of the first transformer is controllably adjusted between the maximum and minimum values.

6. The ballast of claim 5, further comprising a capacitor coupled in parallel across the primary winding of the second transformer, and further coupled in parallel with the bi-directional switch.

7. The ballast of claim 6, said secondary winding of the first transformer further comprising a first secondary winding of the first transformer, the first transformer further comprising a second and a third secondary winding respectively coupled between a gate and a drain for each of the pair of switching elements in the inverter circuit, wherein the inverter circuit further comprises a self-oscillating inverter configured to receive driving signals from the second and third secondary windings of the first transformer.

8. The ballast of claim 1, said load circuit further comprising one or more discharge lamp circuits coupled in parallel with each other, each lamp circuit having a discharge lamp and configured to operate independently of each other lamp circuit.

9. The ballast of claim 8, each lamp circuit further comprising:

a series connection of a capacitor and one of the secondary windings of the second transformer coupled across a filament on a first end of the discharge lamp; and the load circuit further comprising one of the secondary windings of the second transformer coupled across a filament on a second end of each of the one or more discharge lamps.

10. An electronic ballast comprising:

an inverter circuit comprising a pair of switching elements and configured to convert a DC supply signal into an AC signal;

a transformer having a primary winding coupled to an output terminal between the pair of switching elements of the inverter circuit;

a load circuit comprising one or more discharge lamps, the load circuit coupled in parallel with a secondary winding of the transformer; and an inductance control circuit comprising an inductive element coupled in series with the primary winding of the transformer and a bi-directional switch coupled in parallel across the inductive element; and wherein a switch state of the bi-directional switch is controllably adjustable in accordance with a desired duty ratio, a magnitude of a voltage across said secondary winding of the transformer being dependent on a switch state of the bi-directional switch.

11. The ballast of claim 10, wherein the voltage across said secondary winding of the transformer is at a maximum level in a first switch state.

12. The ballast of claim 11, wherein the voltage across said secondary winding of the transformer is at a minimum level in a second switch state, the voltage at the minimum level associated with a relationship between predetermined primary inductance values for the transformer and the inductive element, and further associated with a turns ratio between the primary winding and the secondary winding of the transformer.

13. The ballast of claim 12, the transformer further comprising:

a first transformer;

the winding of the inductive element further comprising a primary winding of a second transformer;

the second transformer further having one or more secondary windings coupled across filaments of the one or more discharge lamps in the load circuit;

wherein no voltage is generated across the secondary windings of the second transformer in a first switch state of the bi-directional switch; and wherein a voltage is generated across the secondary windings of the first transformer to heat the filaments of the one or more discharge lamps in a second switch state of the bi-directional switch.

14. The ballast of claim 13, the inductance control circuit further comprising a capacitor coupled in parallel across the primary winding of the second transformer, and further coupled in parallel with the bi-directional switch.

15. The ballast of claim 14, said secondary winding of the first transformer further comprising a first secondary winding of the first transformer, the first transformer further comprising a second and a third secondary winding respectively coupled between a gate and a drain for each of the pair of switching elements in the inverter circuit, wherein the inverter circuit further comprises a self-oscillating inverter configured to receive driving signals from the second and third secondary windings of the first transformer.

16. The ballast of claim 15, said load circuit further comprising one or more discharge lamp circuits coupled in parallel with each other, each lamp circuit further comprising a series connection of a capacitor and one of the secondary windings of the second transformer coupled across a filament on a first end of a discharge lamp, and the load circuit further comprising one of the secondary windings of the second transformer coupled across a filament on a second end of each of the one or more discharge lamps.

17. An electronic ballast comprising:

an inverter circuit comprising a pair of switching elements and configured to convert a DC supply signal into an AC signal;

a transformer having a primary winding coupled to an output terminal between the pair of switching elements of the inverter circuit and a secondary winding;

a load circuit comprising one or more independently operable discharge lamp circuits coupled in parallel with each other and across the secondary winding of the transformer, each discharge lamp circuit further comprising a discharge lamp and a capacitor coupled in series;

an inductance control circuit comprising an inductive element coupled in series with the primary winding of the transformer and a bi-directional switch coupled in parallel across the inductive element; and wherein a switch state of the bi-directional switch is controllably adjustable in accordance with a desired duty ratio, a magnitude of a voltage across said secondary winding of the transformer being dependent on a switch state of the bi-directional switch, wherein a magnitude of a voltage across each lamp circuit is further dependent on a switch state of the bi-directional switch.

18. The ballast of claim 17, wherein the voltage across said secondary winding of the transformer is at a maximum level in a first switch state.

19. The ballast of claim 18, the transformer further comprising a first transformer, the winding of the inductive element further comprising a primary winding of a second transformer, the second transformer further having one or more secondary windings coupled across filaments of the one or more discharge lamps in the load circuit;

wherein no voltage is generated across the secondary windings of the second transformer in the first switch state of the bi-directional switch;

wherein a voltage is generated across the secondary windings of the first transformer to heat the filaments of the one or more discharge lamps in a second switch state of the bi-directional switch, and the voltage across said secondary winding of the first transformer is at a minimum level in the second switch state; and wherein the voltage at the minimum level is associated with a relationship between predetermined primary inductance values for the first and the second transformers, and further associated with a turns ratio between the primary winding and the secondary winding of the first transformer.

20. The ballast of claim 19, said secondary winding of the first transformer further comprising a first secondary winding of the first transformer, the first transformer further comprising a second and a third secondary winding respectively coupled between a gate and a drain for each of the pair of switching elements in the inverter circuit, wherein the inverter circuit further comprises a self-oscillating inverter configured to receive driving signals from the second and third secondary windings of the first transformer.

* * * * *